US008114451B2

(12) United States Patent
Sierra-Gomez et al.

(10) Patent No.: US 8,114,451 B2
(45) Date of Patent: Feb. 14, 2012

(54) RESEALABLE CLOSURE WITH PACKAGE INTEGRITY FEATURE

(75) Inventors: Gladys Odette Sierra-Gomez, Woodbridge, NJ (US); Ron Exner, Icking (DE); Olav Dagestad, Oslo (NO); Alexis Julian Gracia-Lugo, Bloomingdale, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 635 days.

(21) Appl. No.: 11/616,386

(22) Filed: Dec. 27, 2006

(65) Prior Publication Data

US 2008/0156861 A1 Jul. 3, 2008

(51) Int. Cl.
*A22C 13/00* (2006.01)

(52) U.S. Cl. ..... 426/87; 206/807; 206/459.5; 383/5; 383/203; 383/66; 383/211; 428/40.8

(58) Field of Classification Search ..... 383/5, 203, 383/66, 211; 426/87, 119; 206/807, 459.5; 428/40.8

See application file for complete search history.

(56) References Cited

U.S. PATENT DOCUMENTS

| | | | |
|---|---|---|---|
| 811,092 | A | 1/1906 | Roberts |
| 1,065,012 | A | 6/1913 | Watanabe |
| 1,106,721 | A | 8/1914 | Lewis |
| 1,171,462 | A | 2/1916 | Rice |
| 1,791,352 | A | 2/1931 | Colonnese |
| 1,963,639 | A | 6/1934 | Ahlquist |
| 1,978,035 | A | 10/1934 | Thom |
| 2,066,495 | A | 1/1937 | Swift |
| 2,128,196 | A | 8/1938 | Vogel |
| 2,475,236 | A | 7/1949 | Gollab |
| 2,554,160 | A | 5/1951 | Von Gunten |
| 2,684,807 | A | 7/1954 | Gerrish |

(Continued)

FOREIGN PATENT DOCUMENTS

| | | |
|---|---|---|
| AU | 768679 | 6/2001 |

(Continued)

OTHER PUBLICATIONS

"Margin." Merriam-Webster Online Dictionary. 2010. Merriam-Webster [online], retrieved on May 6, 2010. Retrieved from the Internet: URL:<http://www.merriam-webster.com/dictionary/margin>.*

(Continued)

*Primary Examiner* — Rena Dye
*Assistant Examiner* — Chaim Smith
(74) *Attorney, Agent, or Firm* — Fitch, Even, Tabin & Flannery LLP

(57) ABSTRACT

A resealable package integrity closure includes a film layer forming a top of container and having a flap defining an access opening to gain access to the contents of the container. A sealing panel completely covers the flap of the film layer. A releasable adhesive is provided on either or both the film layer and the sealing panel for adhering the sealing panel to the film layer. The sealing panel is releasable from the film layer by pulling the sealing panel back in a peeling direction and reclosable against the top to seal the access opening when the sealing panel is moved back against the top. A coating of transferable material is provided on either the sealing panel or on the film layer, which is transferable therebetween, respectively, when the sealing panel is pulled back from the film layer for a first time to provide a visual indication that the closure has been previously opened.

27 Claims, 14 Drawing Sheets

U.S. PATENT DOCUMENTS

| | | | | |
|---|---|---|---|---|
| 2,965,224 | A | | 12/1960 | Harwood |
| 3,080,238 | A | | 3/1963 | Howard et al. |
| 3,127,273 | A | | 3/1964 | Monoham |
| 3,179,326 | A | | 4/1965 | Underwood et al. |
| 3,186,628 | A | | 6/1965 | Rohde |
| 3,187,982 | A | | 6/1965 | Underwood et al. |
| 3,235,165 | A | | 2/1966 | Jackson |
| 3,260,358 | A | | 7/1966 | Gottily et al. |
| 3,272,422 | A | | 9/1966 | Miller |
| 3,311,032 | A | | 3/1967 | Lucas |
| 3,331,501 | A | | 7/1967 | Steward, Jr. |
| 3,343,541 | A | | 9/1967 | Bellemy, Jr. |
| 3,373,926 | A | | 3/1968 | Voightman, Sr. et al. |
| 3,454,210 | A | | 7/1969 | Spiegel et al. |
| 3,528,825 | A | | 9/1970 | Doughty |
| 3,595,468 | A | | 7/1971 | Repko |
| 3,618,751 | A | | 11/1971 | Rich |
| 3,651,615 | A | | 3/1972 | Bohner et al. |
| 3,687,352 | A | | 8/1972 | Kalajian |
| 3,740,238 | A | | 6/1973 | Graham |
| 3,885,727 | A | | 5/1975 | Gilley |
| 3,905,646 | A | | 9/1975 | Brackmann et al. |
| 3,910,410 | A | | 10/1975 | Shaw |
| 3,938,659 | A | | 2/1976 | Wardwell |
| 3,966,046 | A | | 6/1976 | Deutschlander |
| 4,156,493 | A | | 5/1979 | Julius |
| 4,185,754 | A | | 1/1980 | Julius |
| 4,192,420 | A | | 3/1980 | Worrell et al. |
| 4,192,448 | A | | 3/1980 | Porth |
| 4,197,949 | A | | 4/1980 | Carlsson |
| 4,258,876 | A | | 3/1981 | Ljungerantz |
| 4,260,061 | A | | 4/1981 | Jacobs |
| 4,273,815 | A | | 6/1981 | Gifford et al. |
| 4,306,367 | A | | 12/1981 | Otto |
| 4,364,478 | A | | 12/1982 | Tuns |
| 4,397,415 | A | | 8/1983 | Lisiecki |
| 4,411,365 | A | | 10/1983 | Horikawa et al. |
| 4,420,080 | A | | 12/1983 | Nakamura |
| 4,464,154 | A | | 8/1984 | Ljungerantz |
| 4,488,647 | A | | 12/1984 | Davis |
| 4,518,087 | A | | 5/1985 | Goglio |
| 4,538,396 | A | | 9/1985 | Nakamura |
| 4,548,824 | A | | 10/1985 | Mitchell et al. |
| 4,548,852 | A | | 10/1985 | Mitchell |
| 4,549,063 | A | | 10/1985 | Ang et al. |
| 4,550,831 | A | | 11/1985 | Whitford |
| 4,552,269 | A | | 11/1985 | Chang |
| 4,557,505 | A | | 12/1985 | Schaefer et al. |
| 4,570,820 | A | | 2/1986 | Murphy |
| 4,572,377 | A | | 2/1986 | Beckett |
| 4,608,288 | A | | 8/1986 | Spindler |
| 4,610,357 | A | | 9/1986 | Nakamura |
| 4,616,470 | A | | 10/1986 | Nakamura |
| 4,625,495 | A | | 12/1986 | Holavach |
| 4,638,911 | A | | 1/1987 | Prohaska |
| 4,648,509 | A | | 3/1987 | Alves |
| 4,651,874 | A | | 3/1987 | Nakamura |
| 4,653,250 | A | | 3/1987 | Nakamura |
| 4,667,453 | A | | 5/1987 | Goglio |
| 4,671,453 | A | | 6/1987 | Cassidy |
| 4,673,085 | A | | 6/1987 | Badouard et al. |
| 4,679,693 | A | | 7/1987 | Forman |
| 4,694,960 | A | | 9/1987 | Phipps et al. |
| 4,696,404 | A | | 9/1987 | Corella |
| 4,723,301 | A | | 2/1988 | Chang |
| 4,738,365 | A | | 4/1988 | Prater |
| 4,739,879 | A | | 4/1988 | Nakamura |
| 4,784,885 | A | | 11/1988 | Carespodi |
| 4,790,436 | A | | 12/1988 | Nakamura |
| 4,798,295 | A | | 1/1989 | Rausing |
| 4,798,296 | A | | 1/1989 | Lagerstedt et al. |
| 4,799,594 | A | | 1/1989 | Blackman |
| 4,811,848 | A | | 3/1989 | Jud |
| 4,818,120 | A | | 4/1989 | Addiego |
| 4,838,429 | A | | 6/1989 | Fabisiewicz et al. |
| 4,840,270 | A | | 6/1989 | Caputo et al. |
| 4,845,470 | A | | 7/1989 | Boldt et al. |
| 4,848,575 | A | | 7/1989 | Nakamura et al. |
| 4,863,064 | A | | 9/1989 | Dailey, III |
| 4,865,198 | A | | 9/1989 | Butler |
| 4,866,911 | A | | 9/1989 | Grindrod et al. |
| 4,874,096 | A | | 10/1989 | Tessera-Chiesa |
| 4,876,123 | A | * | 10/1989 | Rivera et al. |
| 4,902,142 | A | | 2/1990 | Lammert et al. |
| 4,917,247 | A | * | 4/1990 | Jud |
| 4,943,439 | A | * | 7/1990 | Andreas et al. |
| 4,972,953 | A | * | 11/1990 | Friedman et al. |
| 4,998,666 | A | | 3/1991 | Ewan |
| 5,000,320 | A | * | 3/1991 | Kuchenbecker |
| 5,005,264 | A | | 4/1991 | Breen |
| 5,029,712 | A | * | 7/1991 | O'Brien |
| 5,046,621 | A | | 9/1991 | Bell |
| 5,048,718 | A | * | 9/1991 | Nakamura |
| 5,060,848 | A | | 10/1991 | Ewan |
| 5,065,868 | A | * | 11/1991 | Cornelissen et al. |
| 5,076,439 | A | * | 12/1991 | Kuchenbecker |
| 5,077,064 | A | | 12/1991 | Hustad et al. |
| 5,078,509 | A | | 1/1992 | Center et al. |
| 5,082,702 | A | | 1/1992 | Alband |
| 5,096,113 | A | | 3/1992 | Focke |
| 5,100,003 | A | | 3/1992 | Jud |
| 5,103,980 | A | | 4/1992 | Kuchenbecker |
| 5,124,388 | A | | 6/1992 | Pruett et al. |
| 5,158,499 | A | | 10/1992 | Guckenberger |
| 5,161,350 | A | | 11/1992 | Nakamura |
| 5,167,974 | A | | 12/1992 | Grindod et al. |
| 5,174,659 | A | | 12/1992 | Laske |
| 5,184,771 | A | | 2/1993 | Jud et al. |
| 5,197,618 | A | | 3/1993 | Goth |
| 5,222,422 | A | | 6/1993 | Benner, Jr. et al. |
| 5,294,470 | A | | 3/1994 | Ewan |
| 5,307,988 | A | | 5/1994 | Focke et al. |
| 5,333,735 | A | | 8/1994 | Focke et al. |
| 5,344,007 | A | | 9/1994 | Nakamura et al. |
| 5,352,466 | A | | 10/1994 | Delonis |
| 5,366,087 | A | | 11/1994 | Bane |
| 5,375,698 | A | | 12/1994 | Ewart et al. |
| 5,381,643 | A | | 1/1995 | Kazaitis et al. |
| 5,382,190 | A | | 1/1995 | Graves |
| 5,388,757 | A | | 2/1995 | Lorenzen |
| 5,405,629 | A | | 4/1995 | Marnocha et al. |
| 5,407,070 | A | | 4/1995 | Bascos et al. |
| 5,409,116 | A | | 4/1995 | Aronsen |
| 5,460,838 | A | | 10/1995 | Wermund |
| 5,461,845 | A | | 10/1995 | Yeager |
| 5,464,092 | A | | 11/1995 | Seeley |
| 5,499,757 | A | | 3/1996 | Back |
| 5,503,858 | A | | 4/1996 | Reskow |
| 5,505,305 | A | | 4/1996 | Scholz et al. |
| 5,519,982 | A | | 5/1996 | Herber et al. |
| 5,520,939 | A | | 5/1996 | Wells |
| 5,524,759 | A | | 6/1996 | Herzberg et al. |
| 5,531,325 | A | | 7/1996 | Delflander et al. |
| 5,538,129 | A | | 7/1996 | Chester et al. |
| 5,582,853 | A | | 12/1996 | Mamocha et al. |
| 5,582,887 | A | | 12/1996 | Etheredge |
| 5,591,468 | A | | 1/1997 | Stockley, III et al. |
| 5,633,058 | A | | 5/1997 | Hoffer et al. |
| 5,637,369 | A | | 6/1997 | Stewart |
| 5,647,100 | A | | 7/1997 | Porchia et al. |
| 5,647,506 | A | | 7/1997 | Julius |
| 5,664,677 | A | | 9/1997 | O'Connor |
| 5,688,394 | A | | 11/1997 | McBride, Jr. et al. |
| 5,702,743 | A | | 12/1997 | Wells |
| 5,725,311 | A | | 3/1998 | Ponsi et al. |
| D394,605 | S | | 5/1998 | Skiba et al. |
| 5,770,283 | A | | 6/1998 | Gosselin et al. |
| 5,791,465 | A | | 8/1998 | Niki et al. |
| 5,795,604 | A | | 8/1998 | Wells et al. |
| 5,826,101 | A | | 10/1998 | Beck et al. |
| 5,833,368 | A | | 11/1998 | Kaufman |
| 5,855,435 | A | | 1/1999 | Chiesa |
| 5,873,483 | A | | 2/1999 | Gortz et al. |
| 5,873,607 | A | | 2/1999 | Waggoner |
| 5,882,116 | A | | 3/1999 | Backus |
| 5,906,278 | A | | 5/1999 | Ponsi et al. |
| 5,908,246 | A | | 6/1999 | Arimura |

| | | | |
|---|---|---|---|
| 5,928,749 | A | 7/1999 | Forman |
| 5,938,013 | A | 8/1999 | Palumbo et al. |
| 5,939,156 | A | 8/1999 | Rossi et al. |
| 5,945,145 | A | 8/1999 | Narsutis et al. |
| 5,956,794 | A | 9/1999 | Skiba et al. |
| 5,996,797 | A | 12/1999 | Flaig |
| 5,997,177 | A | 12/1999 | Kaufman |
| 6,026,953 | A | 2/2000 | Nakamura et al. |
| 6,029,809 | A | 2/2000 | Skiba et al. |
| 6,056,141 | A | 5/2000 | Navarini et al. |
| 6,060,095 | A | 5/2000 | Scrimager |
| 6,065,591 | A | 5/2000 | Dill et al. |
| 6,066,437 | A | 5/2000 | Kosslinger |
| 6,077,551 | A | 6/2000 | Scrimager |
| 6,113,271 | A | 9/2000 | Scott et al. |
| 6,125,614 | A | 10/2000 | Jones et al. |
| 6,126,009 | A | 10/2000 | Shiffler et al. |
| 6,126,317 | A | 10/2000 | Anderson et al. |
| 6,152,601 | A | 11/2000 | Johnson |
| 6,164,441 | A | 12/2000 | Guy et al. |
| 6,213,645 | B1 | 4/2001 | Beer |
| D447,054 | S | 8/2001 | Hill |
| 6,273,610 | B1 | 8/2001 | Koyama et al. |
| 6,296,884 | B1 | 10/2001 | Okerlund |
| 6,299,355 | B1 | 10/2001 | Schneck |
| 6,309,105 | B1 | 10/2001 | Palumbo |
| 6,318,894 | B1 | 11/2001 | Derenthal |
| 6,364,113 | B1 | 4/2002 | Faasse, Jr. et al. |
| 6,365,255 | B1 | 4/2002 | Kittel et al. |
| 6,383,592 | B1 | 5/2002 | Lowry et al. |
| 6,420,006 | B1 | 7/2002 | Scott |
| 6,428,867 | B1 | 8/2002 | Scott et al. |
| 6,450,685 | B1 | 9/2002 | Scott |
| 6,457,585 | B1 | 10/2002 | Huffer et al. |
| 6,461,043 | B1 | 10/2002 | Healy et al. |
| 6,461,708 | B1 | 10/2002 | Dronzek |
| 6,471,817 | B1 | 10/2002 | Emmert |
| 6,482,867 | B1 | 11/2002 | Kimura et al. |
| 6,517,243 | B2 | 2/2003 | Huffer et al. |
| 6,539,691 | B2 | 4/2003 | Beer |
| 6,554,134 | B1 | 4/2003 | Guibert |
| 6,589,622 | B1 | 7/2003 | Scott |
| 6,592,260 | B1 | 7/2003 | Randall et al. |
| 6,594,872 | B2 | 7/2003 | Cisek |
| 6,691,886 | B1 | 2/2004 | Berndt et al. |
| 6,698,928 | B2 | 3/2004 | Miller |
| 6,726,054 | B2 | 4/2004 | Fagen et al. |
| 6,726,364 | B2 | 4/2004 | Perell et al. |
| 6,746,743 | B2 | 6/2004 | Knoerzer et al. |
| 6,767,604 | B2 | 7/2004 | Muir, Jr. et al. |
| 6,865,860 | B2 | 3/2005 | Arakawa et al. |
| 6,889,483 | B2 | 5/2005 | Compton et al. |
| 6,918,532 | B2 | 7/2005 | Sierra-Gomez et al. |
| 6,929,400 | B2 | 8/2005 | Razeti et al. |
| 6,951,999 | B2 | 10/2005 | Monforton et al. |
| 6,983,875 | B2 | 1/2006 | Emmott |
| 7,007,423 | B2 | 3/2006 | Andersson et al. |
| 7,021,827 | B2 | 4/2006 | Compton et al. |
| 7,032,757 | B2 | 4/2006 | Richards et al. |
| 7,040,810 | B2 | 5/2006 | Steele |
| 7,165,888 | B2 | 1/2007 | Rodick |
| 7,172,779 | B2 | 2/2007 | Castellanos et al. |
| 7,213,710 | B2 | 5/2007 | Cotert |
| 7,228,968 | B1 | 6/2007 | Burgess |
| 7,261,468 | B2 | 8/2007 | Schneider et al. |
| 7,262,335 | B2 | 8/2007 | Motsch et al. |
| 7,302,783 | B2 | 12/2007 | Cotert |
| 7,422,142 | B2 | 9/2008 | Arippol |
| 7,475,781 | B2 | 1/2009 | Kobayashi et al. |
| 7,516,599 | B2 | 4/2009 | Doll et al. |
| 7,533,773 | B2 | 5/2009 | Aldridge et al. |
| 7,600,641 | B2 | 10/2009 | Burgess |
| 7,717,620 | B2 | 5/2010 | Hebert et al. |
| 2001/0000480 | A1 | 4/2001 | Stagg et al. |
| 2003/0019780 | A1 | 1/2003 | Parodi et al. |
| 2003/0039412 | A1 | 2/2003 | Rodick |
| 2003/0118255 | A1 | 6/2003 | Miller |
| 2003/0183637 | A1 | 10/2003 | Zappa et al. |
| 2003/0183643 | A1 | 10/2003 | Fagen et al. |
| 2003/0210838 | A1 | 11/2003 | Steele |
| 2003/0223656 | A1 | 12/2003 | Razeti et al. |
| 2004/0011677 | A1 | 1/2004 | Arakawa et al. |
| 2004/0062838 | A1 | 4/2004 | Castellanos et al. |
| 2004/0067326 | A1 | 4/2004 | Knoerzer et al. |
| 2004/0083680 | A1 | 5/2004 | Compton et al. |
| 2004/0091184 | A1 | 5/2004 | Miller |
| 2004/0112010 | A1 | 6/2004 | Richards et al. |
| 2004/0150221 | A1 | 8/2004 | Brown |
| 2004/0175060 | A1 | 9/2004 | Woodham et al. |
| 2004/0180118 | A1 | 9/2004 | Renger et al. |
| 2004/0206637 | A1 | 10/2004 | Sierra-Gomez et al. |
| 2005/0000965 | A1 | 1/2005 | Boardman |
| 2005/0084186 | A1 | 4/2005 | Caris |
| 2005/0117819 | A1 | 6/2005 | Kingsford et al. |
| 2005/0220371 | A1 | 10/2005 | Machacek |
| 2005/0247764 | A1 | 11/2005 | Sierra-Gomez et al. |
| 2005/0276525 | A1* | 12/2005 | Hebert et al. ..... 383/203 |
| 2006/0018569 | A1 | 1/2006 | Bonenfant |
| 2006/0124494 | A1 | 6/2006 | Clark, Jr. et al. |
| 2006/0144911 | A1 | 7/2006 | Sierra-Gomez et al. |
| 2006/0171611 | A1 | 8/2006 | Rapparini |
| 2006/0251342 | A1 | 11/2006 | Forman |
| 2006/0257599 | A1 | 11/2006 | Exner et al. |
| 2006/0285779 | A1 | 12/2006 | Golas |
| 2007/0023435 | A1 | 2/2007 | Sierra-Gomez et al. |
| 2007/0023436 | A1 | 2/2007 | Sierra-Gomez et al. |
| 2007/0095709 | A1 | 5/2007 | Saito et al. |
| 2007/0140600 | A1 | 6/2007 | Nowak et al. |
| 2007/0209959 | A1 | 9/2007 | Burgess |
| 2007/0269142 | A1 | 11/2007 | Tyska et al. |
| 2007/0275133 | A1 | 11/2007 | Sierra-Gomez et al. |
| 2008/0013869 | A1 | 1/2008 | Forman |
| 2008/0037911 | A1 | 2/2008 | Cole et al. |
| 2008/0060751 | A1 | 3/2008 | Arrindell |
| 2008/0063759 | A1 | 3/2008 | Raymond et al. |
| 2008/0063760 | A1 | 3/2008 | Raymond et al. |
| 2008/0131035 | A1 | 6/2008 | Rogers |
| 2008/0135428 | A1 | 6/2008 | Tallier |
| 2008/0152264 | A1 | 6/2008 | Pokusa et al. |
| 2008/0214376 | A1 | 9/2008 | Bonenfant |
| 2009/0028472 | A1 | 1/2009 | Andersson et al. |
| 2009/0190866 | A1 | 7/2009 | Hughes |
| 2009/0211938 | A1 | 8/2009 | Aldridge |
| 2009/0273179 | A1 | 11/2009 | Scott et al. |
| 2010/0113241 | A1 | 5/2010 | Herbert et al. |

FOREIGN PATENT DOCUMENTS

| | | |
|---|---|---|
| AU | 2002334419 | 5/2003 |
| AU | 2004295316 | 6/2005 |
| AU | 2005254459 | 12/2005 |
| DE | 9014065.6 | 4/1991 |
| DE | 4134567 | 10/1991 |
| EP | 388310 | 9/1990 |
| EP | 474981 | 3/1992 |
| EP | 0474981 | 3/1992 |
| EP | 488967 | 6/1992 |
| EP | 0546369 | 6/1993 |
| EP | 0447636 | 3/1994 |
| EP | 0613824 | 9/1994 |
| EP | 0629561 | 12/1994 |
| EP | 0667828 | 8/1995 |
| EP | 0661154 | 11/1995 |
| EP | 0752375 | 8/1997 |
| EP | 0758993 | 3/1998 |
| EP | 0905048 | 3/1999 |
| EP | 0796206 | 1/2000 |
| EP | 0744357 | 10/2000 |
| EP | 1086906 | 3/2001 |
| EP | 1375380 | 1/2004 |
| EP | 1382543 | 1/2004 |
| EP | 1437311 | 7/2004 |
| EP | 1449789 | 8/2004 |
| EP | 1457424 | 9/2004 |
| EP | 1488936 | 10/2004 |
| EP | 1477425 | 11/2004 |
| EP | 1086906 | 5/2005 |
| EP | 1608567 | 12/2005 |
| EP | 1609737 | 12/2005 |

| | | |
|---|---|---|
| EP | 1609737 | 1/2006 |
| EP | 1637472 | 3/2006 |
| EP | 1697230 | 9/2006 |
| EP | 1755980 | 2/2007 |
| EP | 1770025 | 4/2007 |
| EP | 1608567 | 7/2007 |
| EP | 1908696 | 4/2008 |
| EP | 1939107 | 7/2008 |
| EP | 1619137 | 9/2008 |
| EP | 1858776 | 10/2008 |
| EP | 1375380 | 11/2008 |
| EP | 1712468 | 12/2008 |
| EP | 1846306 | 3/2009 |
| EP | 2033910 | 3/2009 |
| FR | 1327914 | 4/1963 |
| FR | 2674509 | 2/1995 |
| FR | 2766794 | 2/2009 |
| GB | 2276095 | 9/1994 |
| JP | 60080405 | 5/1985 |
| JP | 9150872 | 6/1997 |
| JP | 09156677 | 6/1997 |
| JP | 10059441 | 3/1998 |
| JP | 10129685 | 5/1998 |
| JP | 11198977 | 7/1999 |
| JP | 2000335542 | 12/2000 |
| JP | 2006062712 | 3/2006 |
| WO | 9532902 | 12/1995 |
| WO | 9725200 | 7/1997 |
| WO | 02/066341 | 8/2002 |
| WO | 03/013976 | 2/2003 |
| WO | 03/059776 | 7/2003 |
| WO | 2006080405 | 8/2006 |
| WO | 2007090419 | 8/2007 |
| WO | 2008051813 | 5/2008 |
| WO | 2008074060 | 6/2008 |
| WO | 2008122961 | 10/2008 |
| WO | 2009065120 | 5/2009 |
| WO | 2009111153 | 9/2009 |

OTHER PUBLICATIONS

U.S. Appl. No. 11/500,497, Cole et al.

Reclosure system lengthens food life, Packaging News PPMA Preview, Sep. 2001, p. 40.

Reseal-It. Web page Internet print out accessed Mar. 14, 2005; 19 pages.

Patent Abstracts of Japan, vol. 1997 No. 10, Oct. 31, 1997 and JP09156677 A (Fuji Seal Co. Ltd.) (Jul. 6, 1997) abstract in English and 7 figures.

"Elite Edam Cheese", Mintel gnpd, Dec. 3, 2001, Mintel Publishing.

"New Easy Peel Cheese Packaging", Mintel gnpd, Aug. 10, 2001, Mintel Publishing.

"Cheese Range", Mintel gnpd, Jan. 26, 2001, Mintel Publishing.

"Soft Bread Sticks", Mintel gnpd, Mar. 20, 1998, Mintel Publishing.

"New on the Shelf-Produce Instruction and Packaging Trends", Circle Reader Service Card No. 93, Aug. 1998, Baking & Snack.

Reseal-it. [Homepage of Macfarlane Group] [Online] 2005, Available at: http//www.real-it.se [accessed Mar. 14, 2005].

Machinery Update, Mar./Apr. 2002, pp. 59-60.

Giant Baby Wipes package, item No. 80203-91, resealable package having die cut-out portions (tabs) which remain affixed to the top of the package after label is withdrawn from the top, whereby tamper evidence is indicated by a misalignment of the die cut-out portions with the holes formed in the label.

* cited by examiner

RESEALABLE CLOSURE WITH PACKAGE INTEGRITY FEATURE

FIELD OF THE INVENTION

The present invention relates to a resealable closure for packages storing articles and, more particularly, resealable closures for packages having a package integrity indicator.

BACKGROUND OF THE INVENTION

Some containers for food products, such as cookies and other snacks, typically include an outer wrapper. In one type of container, the wrapper surrounds a frame which acts as a tray to hold the food product and to protect the food product from damage. Other food products come packaged in plastic trays, such as thermoform trays which are sealed on the top using some type of lidding material. One recent advancement in the art of food container closures includes a resealable closure disclosed in U.S. Pat. No. 6,918,532 (hereinafter "the '532 patent"), herein incorporated by reference, which discloses a wrapper which forms a top of the container, which has an access opening covered by a resealable sealing panel.

In the packaging art, different methods have been used to indicate whether a package has been previously opened or whether the integrity of the package has been compromised, which is often referred to in the art as "tamper-evident." For example, in the tissue wipes packaging art of U.S. Pat. No. 6,428,867 (hereinafter "the '867 patent"), a means for indicating package integrity includes a tamper-evident tab with one or more ink layers which is initially an integral part of a sealing panel prior to the package being opened for a first time. The tab is transferred with one of the ink layers from the sealing panel to the top of the package when the closure has been opened for a first time. Tamper-evidence is indicated in a misalignment of the sealing panel with an image on the transferred tab, which is visible through a transparent outer layer of the sealing panel, after the sealing panel has been resealed to the top of the package.

There is a need for improvement in the art for package integrity indicators for a resealable closure, preferably suitable for use with a resealable closure for containers or packages containing food items.

SUMMARY OF THE INVENTION

The present invention generally relates to a resealable closure for a container formed from a two-ply material, which has a package integrity indicator in the form of a coating of material, such as ink or paint, which transfers between a sealing panel and a film layer disposed therebelow when the container has been opened for a first time.

The present invention, in one form, comprises a package integrity closure comprising a film layer forming a top of a container and having a flap defining an access opening to gain access to the contents of the container. A sealing panel completely covers the flap of the film layer. A releasable adhesive is provided on either or both the sealing panel or the film layer for adhering the sealing panel to the film layer. The sealing panel is releasable from the film layer by pulling the sealing panel back in a peeling direction and reclosable against the top to seal the access opening when the sealing panel is moved back against the top. A coating of transferable material is disposed on either the film layer adjacent the access opening on a surface facing the sealing panel or on the sealing panel on a surface facing the film layer. The coating is transferable from either the film layer or sealing panel to the sealing panel or the film layer, respectively. The coating transfer occurs without a transfer of a portion of the film layer or sealing panel bonded to the coating when the sealing panel is pulled back from the film layer for a first time to thereby provide a visual indication that the closure has been previously opened. The sealing panel can either be a top layer of a multilayer material forming the top of the container, such as the container disclosed in U.S. patent application Ser. No. 11/500,497, herein incorporated by reference, or a discrete label applied over a film layer forming the top of the container, such as the container of the '532 patent. Further, the perimeter edge of the sealing panel can be either linear or nonlinear such as a zigzag pattern.

Advantageously, the coating of transferable material is a different color or pattern than that of the film layer or sealing panel. If the coating is initially applied to the sealing panel, evidence that the closure has been previously opened is observable in the form of a partial outline of the coating transferred to the film layer adjacent the sealing panel, which is visible due to a slight misalignment of the sealing panel with the film layer when the sealing panel is reapplied to the top of the container upon closure. If the perimeter edge of the sealing panel is nonlinear, such as a zigzag pattern, a slight misalignment of the zigzag pattern between the sealing panel and the film layer will be visible as a slightly misaligned pattern.

A secondary evidence of package integrity is provided in the form of a reduction in peel force between the sealing panel and the film layer after the closure has been previously opened and subsequently resealed due to a deadening effect resulting from the transfer of the coating from the sealing panel or film layer to the adhesive on the opposite surface or the transfer of adhesive with coating material from either the film layer or sealing panel to the opposite surface.

The present invention, in another form thereof, concerns a package integrity indicating closure comprising an at least two-ply material comprising a first film layer adhesively joined to a second film layer. A first tear line is formed in the first film layer defining a first panel for providing an access opening through the first film layer when separated from the first film layer along the first tear line. A second film layer having a second layer tear line defines a sealing panel which completely covers the first panel. The sealing panel is releasably adhered to the first film layer, such that the sealing panel is separable from the first film layer to expose the access opening. A coating of transferable material is on either the sealing panel on a surface facing the first film layer or on the first film layer facing the sealing panel so that upon opening the closure, a portion of the coating is transferred from between the second film layer and the first film layer to provide a visual indication that the closure has been opened after the sealing panel has been peeled back from the first film layer for a first time.

The present invention, in another form thereof, concerns a package integrity indicating closure for a container comprising an at least two-ply material comprising an inner layer adhesively joined to an outer layer and forming a top of the container. The inner layer has an inner layer panel and the outer layer has a sealing panel formed therein, which completely covers the inner layer panel. The first panel and the sealing panel are permanently joined to each other to provide an access opening into the container. A releasable adhesive is provided on one or both the sealing panel and the inner layer for adhering the sealing panel to the inner layer. The sealing panel is releasable from the inner layer by pulling the sealing panel back in a peeling direction and reclosable against the top to seal the opening when the sealing panel is moved back against the top. A coating of transferable material is on either the sealing panel or on the inner layer facing the sealing panel so that upon opening the closure, a portion of the coating is transferred from between the sealing panel and the inner film layer to provide a visual indication that the closure has been opened after the sealing panel has been peeled back from the inner layer for a first time.

The present invention, in another form thereof, relates to a package integrity indicating food container comprising a tray and an at least two-ply material comprising an inner layer adhesively joined to an outer layer to form a top over the tray. The top is formed to provide an access opening for access to the food items disposed in the tray. The inner layer has a first panel and the outer layer has a sealing panel formed therein, which completely covers the first panel. The first panel and sealing panel are permanently joined to each other to form the access opening into the container. A coating of transferable material is on either the outer layer adjacent the access opening on a surface facing the inner layer or the inner layer facing the sealing panel. A releasable adhesive is provided on either or both the inner layer on a perimeter outside the first panel or the sealing panel, which lies thereover for adhering the sealing panel to the inner layer. The sealing panel is releasable from the inner layer by pulling the sealing panel layer back in a peeling direction and reclosable against the top to seal the opening when the sealing panel is moved back against the top whereby, upon opening the closure for a first time, a portion of the coating is transferred from between the outer layer and the inner layer to provide a visual indication that the closure has been opened.

Food items disposed in the container may include cookies, crackers, peanuts, cheese, sliced meats and semi-solid foods.

Other features and advantages of the present invention are stated in or apparent from detailed descriptions of the presently preferred embodiments of the invention found herebelow.

DETAILED DESCRIPTION

Figure 1:
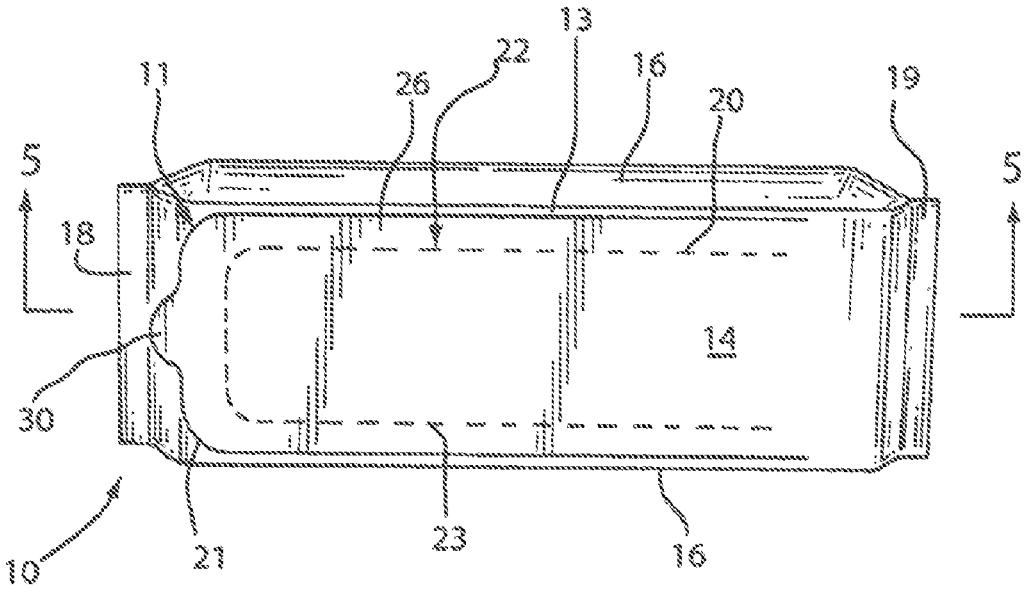
FIG. 1 is a perspective view of a package including an exemplary closure prior to an initial opening, according to the present invention.

Referring to the figures and, in particular, FIGS. 1-6, there is shown package 10 with closure 11, which incorporates a package integrity feature. Package 10 includes a two-ply wrapper comprising a first, inner film layer 12 and a second, outer film layer 13, forming a top or upper surface 14, sides 16, lower surface (not shown), and crimped ends 18,19. The inner film layer 12 and outer film layer 13 are formed from a polymeric film or other flexible material that has been cut, folded or otherwise pressed to define an inner space or receptacle for receiving the desired product, such as food items, to be provided within the package 10. Package 10 can be used to store and distribute food items such as cookies, crackers, candy or other items. The outer film layer 13 may include graphics or other indicia to identify the contents of the package 10.

Advantageously, the inner film layer 12 is coextensively formed and adhesively joined to the outer film layer 13. During the manufacturing of package 10, the inner film layer 12 is die cut along first tear line 20 and the outer film layer 13 is die cut along a second tear line 21, as disclosed in U.S. Patent Application Publication No. 2005/0276525, herein incorporated by reference.

The first tear line 20 is formed as a continuous tear line to define a panel 22. The panel 22 is separated from the remainder of the inner film layer 12 to expose an opening 24 (FIGS. 2A , 4 and 6), whereby access to the contents of the package 10 may be gained.

The second tear line 21 defines sealing panel 26 of the outer film layer 13. The sealing panel 26 extends beyond the periphery of the first tear line 20, adjacent to the opening 24, so that the sealing panel 26 completely covers and extends beyond the perimeters of the panel 22.

The side of the sealing panel 26 which faces the inner film layer 12 is coated with a releasable adhesive 27 (see FIGS. 2*a*, 3, 5 and 6) so that the sealing panel 26 may be releasably secured to the inner film layer 12 at a position adjacent to the panel 22. Alternatively, or along with resealable adhesive 27, resealable adhesive 27 can be coated on the inner film layer 12 adjacent the outside perimeter of the panel 22. The releasable adhesive can be any pressure sensitive adhesive which allows resealing and includes, but is not limited to, the adhesives disclosed in U.S. Patent Application Publication No. 2006/0144911, herein incorporated by reference. The sealing panel 26 is provided with a tab 30 or other gripping feature which is not coated with the adhesive 27 so that the sealing panel 26 may be peeled back from the inner film layer 12 to open the package 10.

A coating of transferable material 28, such as ink or paint, is disposed or otherwise printed on a perimeter edge 34 of the sealing panel 26 on top of the adhesive 27. Coating 28 is any appropriate transferable paint or ink known in the packaging art including but not limited to those disclosed in U.S. Patent Application Publication No. 2006/0257599, herein incorporated by reference.

Alternatively, coating 28 can be applied directly to the sealing panel 26 rather than on top of adhesive 27. Adhesive 27 can either be applied to the sealing panel adjacent the coating only or on top of the coating as well.

Adhesive 29 is applied along the inner film layer 12 approximate the second tear line 21. Adhesive 29 can be any known adhesive in the art which, advantageously, has a bond strength between the adhesive 29 and the coating 28 which is greater than the bond between the coating 28 and the sealing panel 26 and the bond between coating 28 and adhesive 27. When the closure 11 is opened for a first time, a portion of the coating 28 will be transferred from the sealing panel 26 to the adhesive 29 covered portion of the inner film layer 12, as will be discussed in greater detail below.

In an alternative embodiment, there is no adhesive 29 applied along the inner film layer 12. Instead, coating 28 forms a sufficiently strong bond with the inner film layer 12 such that upon opening closure 11 for a first time, some or all of the coating 28 will be transferred from the sealing panel 26 to the inner film layer 12.

Figure 2A:
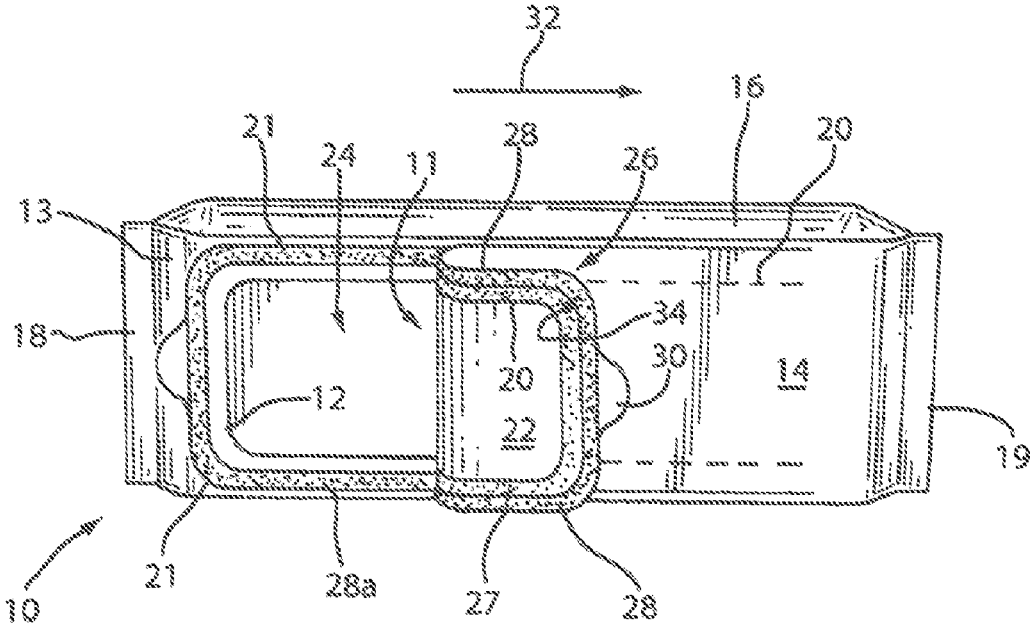
FIG. 2A is the package of FIG. 1, shown in a partially opened condition.
Figure 2B:
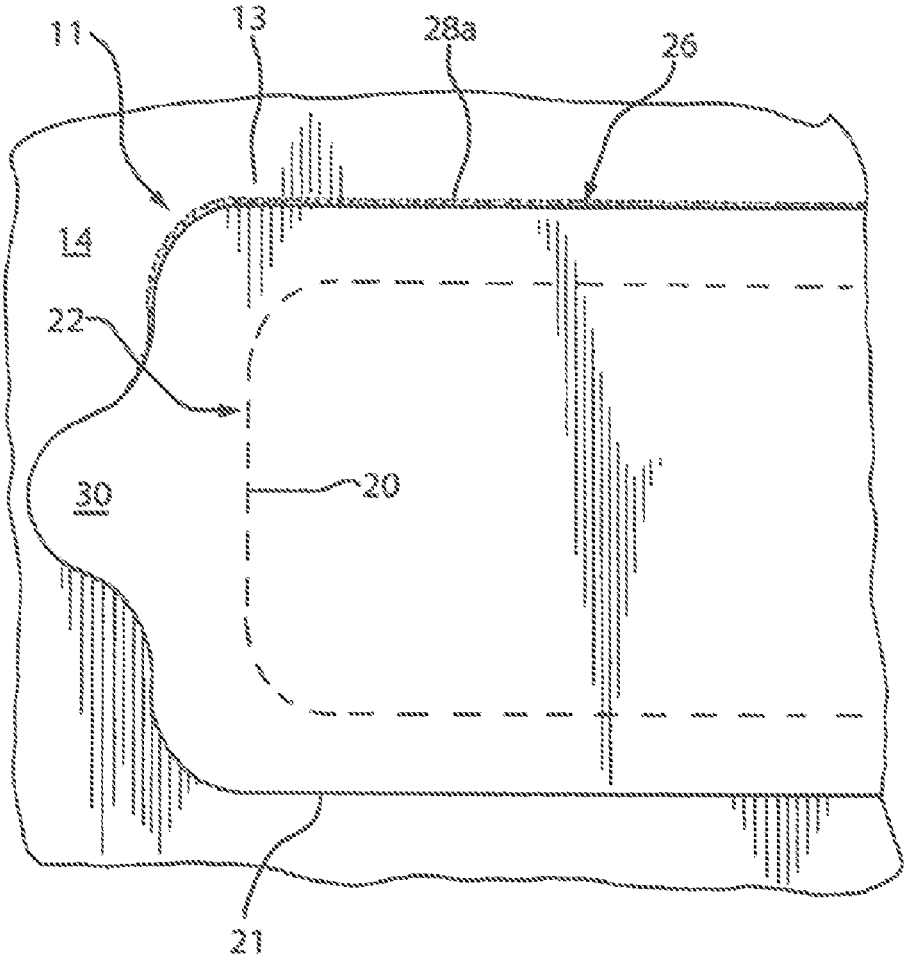
FIG. 2B is a partial enlargement of the package of FIG. 1, after the package has been opened and subsequently closed.
Figure 5:
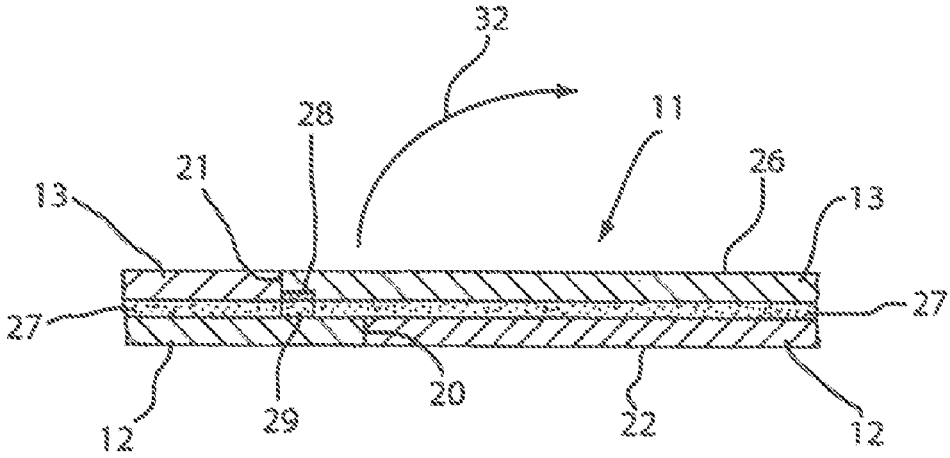
FIG. 5 is a partial enlarged cross-sectional view of the closure of FIG. 1, taken along line 5-5 of FIG. 1.
Figure 6:
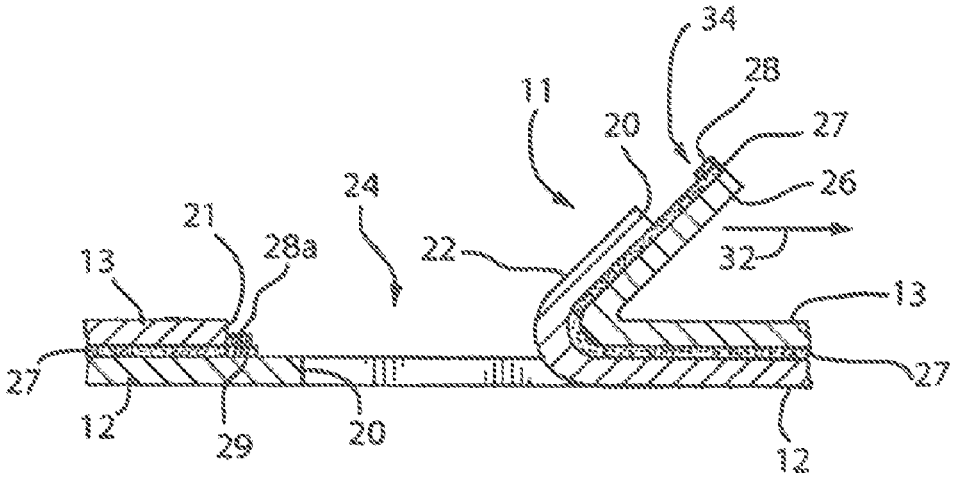
FIG. 6 is a partial enlarged cross-sectional view of the closure, similar to FIG. 5, depicting an initial opening of the closure.
Figure 7:
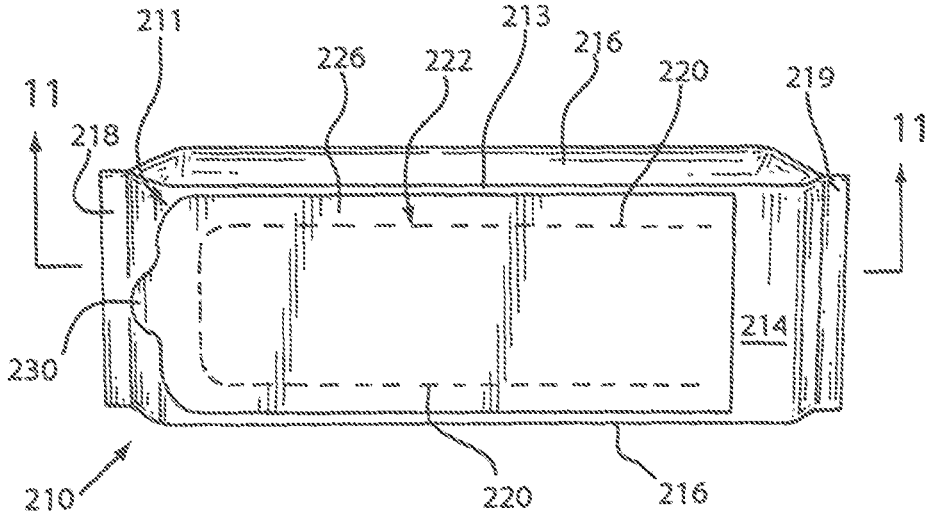
FIG. 7 is a perspective view of another package including an exemplary closure prior to an initial opening, according to another embodiment of the present invention.

As shown in FIGS. 5 and 6, the first panel 22 is separated from the remainder of the inner film layer 12 along the first tear line 20 and remains adhered to the sealing panel 26 as the sealing panel 26 is peeled back in a peeling direction indicated by arrow 32 (FIGS. 2A and 5) to open the package 10. After the contents of the package have been accessed and it is desired to reseal the package 10, the sealing panel may be reapplied to the inner film layer 12, approximately in its original position, as depicted in FIG. 2B. Because the sealing panel 26 extends beyond the periphery of the panel 22, the releasable adhesive 27 disposed thereon facilitates the resealing of the package 10 with the panel 22 positioned over the access opening 24.

In addition, when the sealing panel 26 is peeled away from the inner film layer 12 to separate the panel 22 for a first time, a portion of the coating 28, namely transferred coating 28*a*, is separated from the sealing panel 26 and remains or adheres to the adhesive 29 disposed on the inner film layer 12. Advantageously, the color of the coating 28 is different than the color of the top surface of the package 10. Although a residual amount of coating 28 is depicted, alternatively, all of coating 28 can be transferred from the sealing panel 26 to the inner film layer 12.

Referring specifically to FIG. 2B, when the sealing panel 26 is reapplied to the top of the package 10, due to inevitable slight misalignment of the sealing panel 26 relative to the inner film layer 12, a portion of the transferred coating 28*a* will be visible and thus indicate that the package 10 has been previously opened.

In addition to the visual indication, package integrity is further evident after the package has been previously opened and resealed due to a deadening effect of adhesive 29 due to the transfer of the coating 28 thereto. As a result, the transferred coating 28*a* deadens the adhesive 29 along the portions where the coating 28*a* has been transferred. Consequently, a previously opened package, having a deadened portion of the adhesive 29, is easier to open a second and subsequent time than it is initially.

Figure 2C:
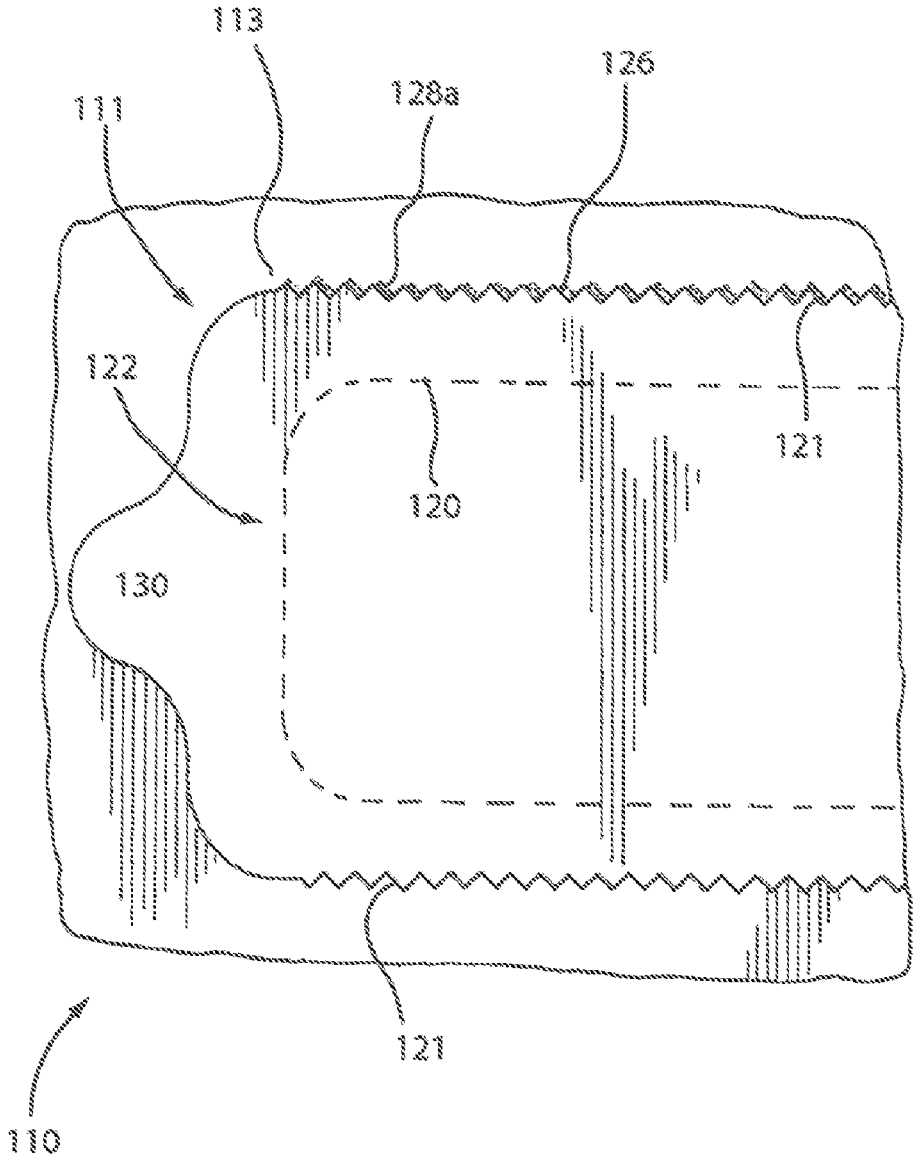
FIG. 2C is an enlarged partial plan view of a package, similar to the one of FIG. 1, with an alternative sealing panel, in accordance with the present invention.
Figure 3:
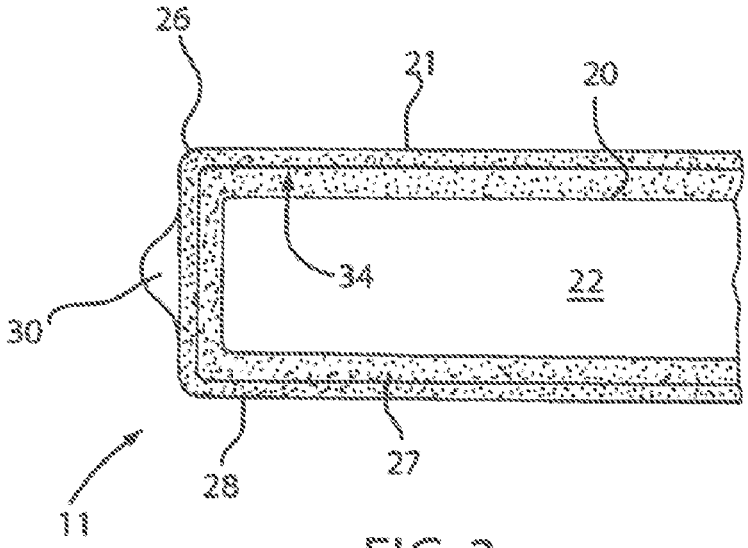
FIG. 3 is a partial plan view of a sealing panel with attached film layer flap of the package of FIG. 1, as viewed from below, in its initial condition.
Figure 4:
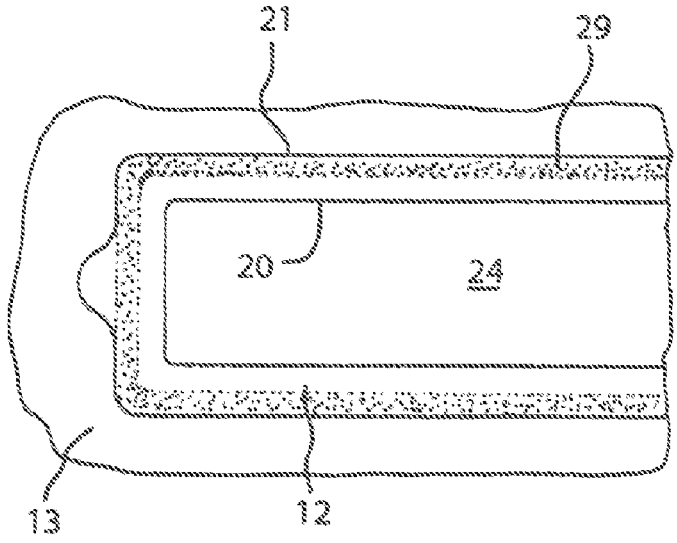
FIG. 4 is a partial plan view of the top of the package of FIG. 1, with the sealing panel not shown, prior to the package being opened.

An alternative embodiment to package 10 is depicted in FIG. 2C where like elements are raised by 100. Package 110 is shown as a partial plan view and is identical to package 10, except the tear line in the outer film layer 121 has a zigzag pattern rather than the linear tear line 21 of package 10. All other features of closure 111 are identical to those of closure 11. Following an initial opening and resealing of closure 111, the transfer coating 128*a* will appear as a misaligned zigzag pattern with the pattern of second tear line 121, thus indicating that the closure 111 has been previously opened.

Referring now to FIGS. 7-12, in an alternative embodiment where like elements to the package 10 have been increased by 200, package 210 includes closure 211, a film layer 214 forming the top sides and crimped ends 218, 219. The film layer 214 is die cut along tear line 220. A sealing panel 226 is adhesively sealed to the top surface of package 210.

Figure 9:
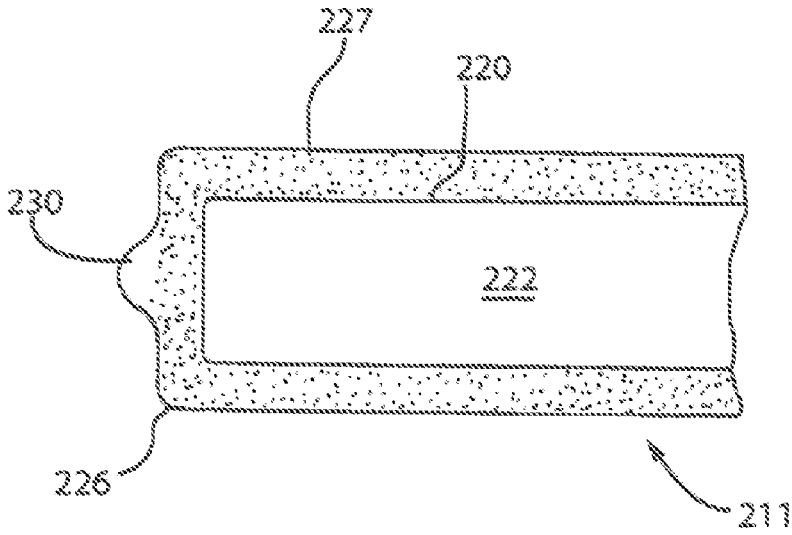
FIG. 9 is a partial plan view of a sealing panel with attached film layer flap of the package of FIG. 7, as viewed from below, in its initial condition.
Figure 10:
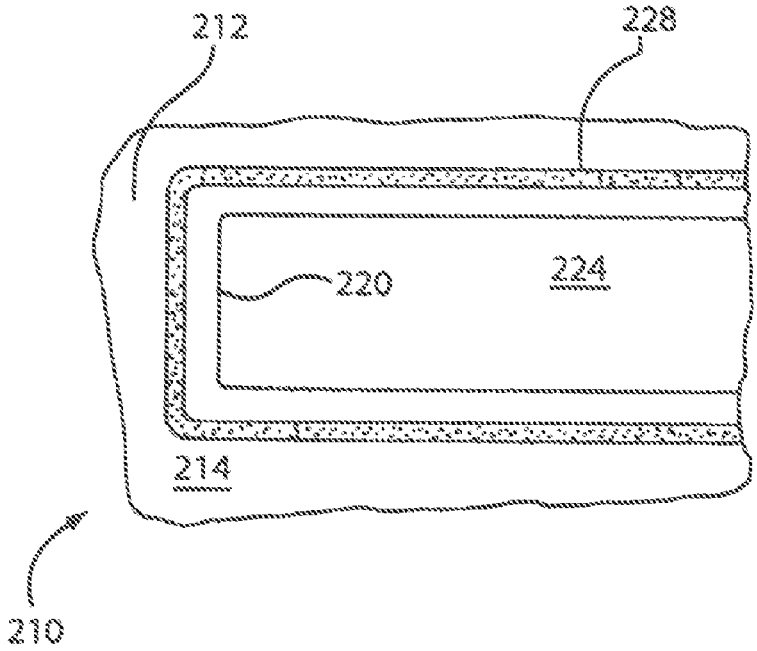
FIG. 10 is a partial plan view of the top of the package of FIG. 7, with the sealing panel not shown, prior to the package being opened.
Figure 11:
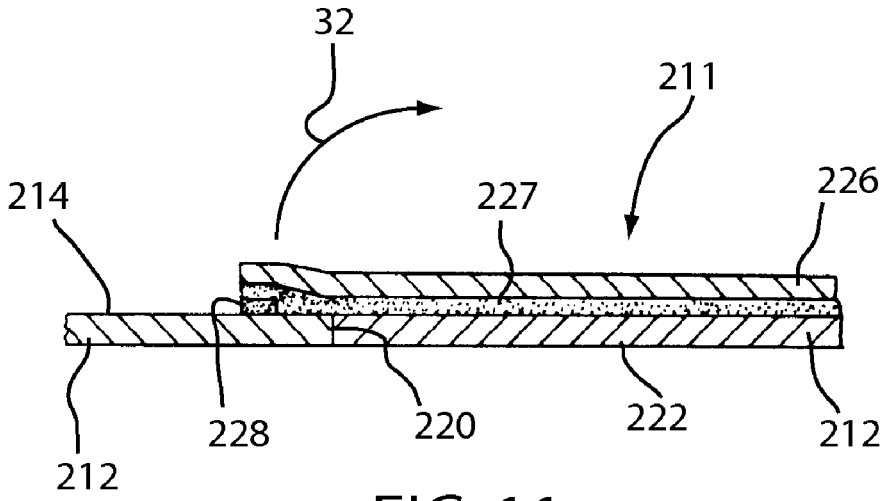
FIG. 11 is a partial enlarged cross-sectional view of the closure of FIG. 7, taken along line 11-11 of FIG. 7.

Referring now specifically to FIGS. 9 and 10, FIG. 9 shows the sealing panel 226 with flap 222 and FIG. 10 shows the top of package 210 with the sealing panel not shown for simplification to illustrate the various layers and surfaces prior to an initial opening of the closure 211. A coating of transferable material 228 is initially disposed around the perimeter of opening 224 on film layer 212, in a similar manner as coating 28 is applied to package 10. Advantageously, the coating 228 is applied to portions of the film layer 212 that will be in direct contact with a releasable adhesive 227 of the sealing panel 226 when the sealing panel is placed over top 214 of package 210. Advantageously, the coating 228 has a weaker bonding strength to the film layer 212 than the bond strength of the coating 228 to the releasable adhesive 227.

Figure 8A:
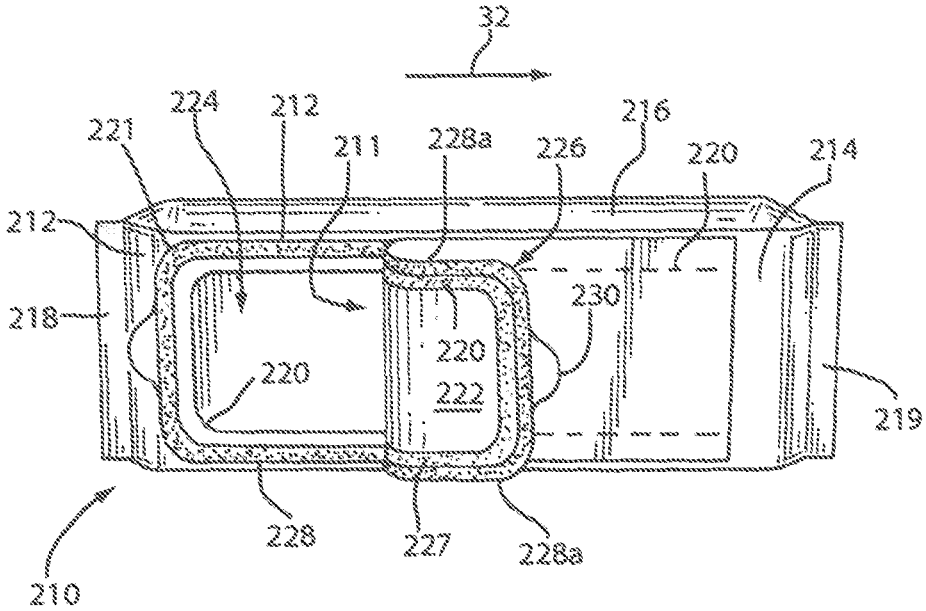
FIG. 8A is the package of FIG. 7, shown in a partially opened condition.
Figure 8B:
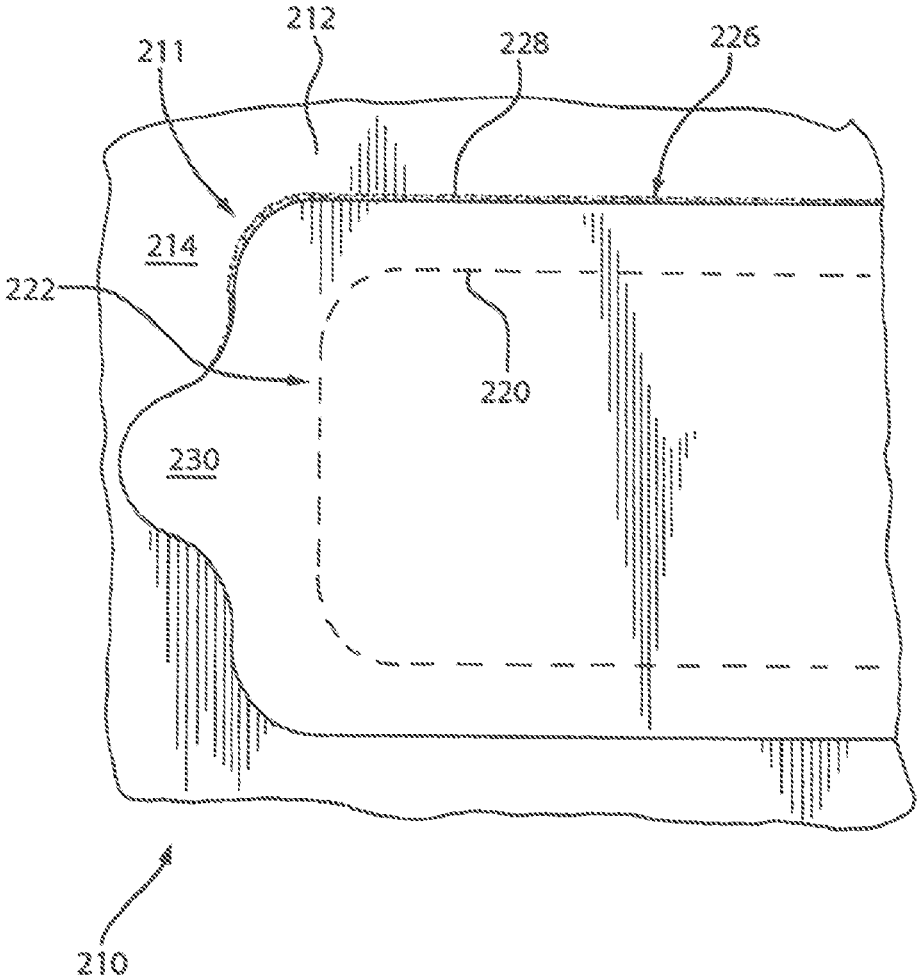
FIG. 8B is a partial enlargement of the package of FIG. 7, after the package has been opened and subsequently closed.
Figure 12:
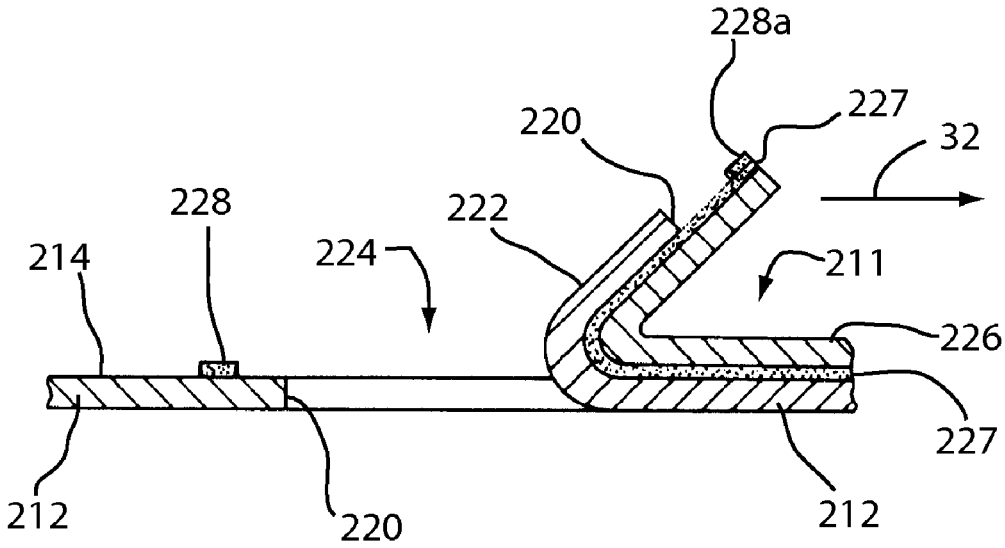
FIG. 12 is a partial enlarged cross-sectional view of the closure, similar to FIG. 11, depicting a resealed configuration of the closure after the initial opening.
Figure 13:
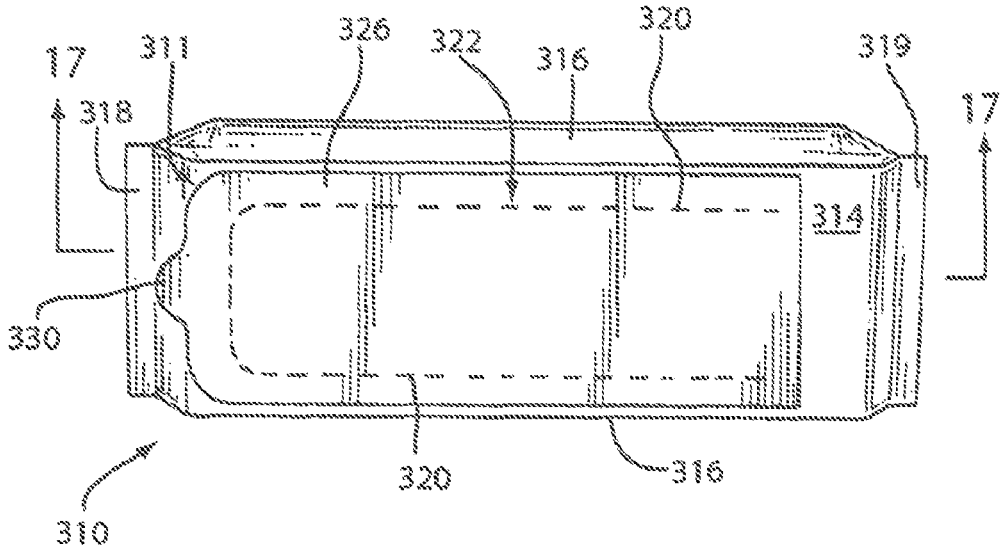
FIG. 13 is a perspective view of another package including an exemplary closure prior to an initial opening, in accordance with another aspect of the present invention.

When the sealing panel 226 is pulled back for a first time, some or all of the coating 228, for example, transferred coating portion 228*a*, will be transferred from the film layer 212 to the releasable adhesive 227, thus deadening those portions of the adhesive 227 now covered with transferred coating 228*a*, as shown in FIGS. 8A and 12. The transfer of the coating 228 to the sealing panel 226 provides a visual indicia to alert customers that the sealing panel 226 has already been peeled back, thus providing indicia of package integrity, as shown in FIG. 8A. In addition, package integrity is provided by a reduction in peel force between the sealing panel 226 and the film layer 212 due to the deadened areas of the adhesive 227 where the coating 228*a* has now been transferred after the package 210 has been previously opened. It should be noted that the coating 228 can be deposited partially or totally around the perimeter of the access opening 224. In addition, further visual indicia is provided by viewing a portion of coating 228 observable when viewing the top 214 of package 210 due to slight misalignment of the sealing panel 226, as shown in FIG. 8B.

Figure 14A:
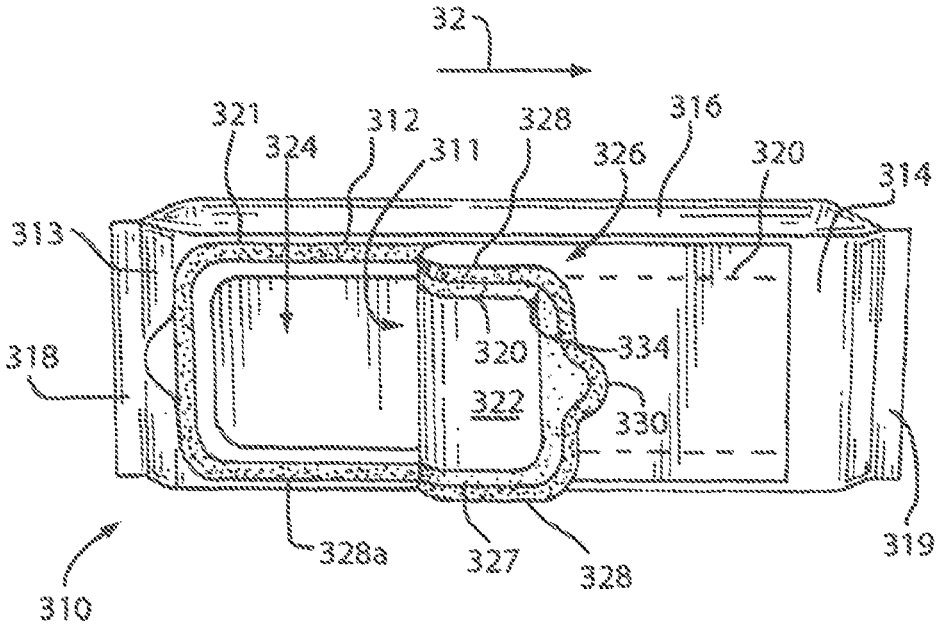
FIG. 14A is the package of FIG. 13, shown in a partially opened condition.
Figure 14B:
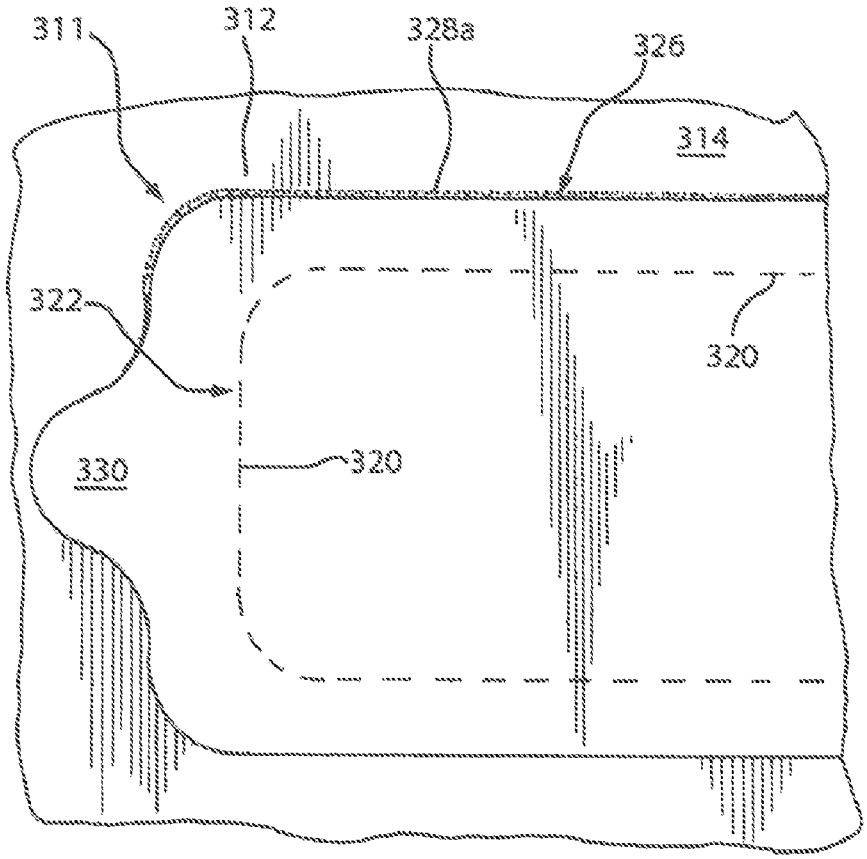
FIG. 14B is a partial enlargement of the package of FIG. 13, after the package has been opened and subsequently closed.
Figure 15:
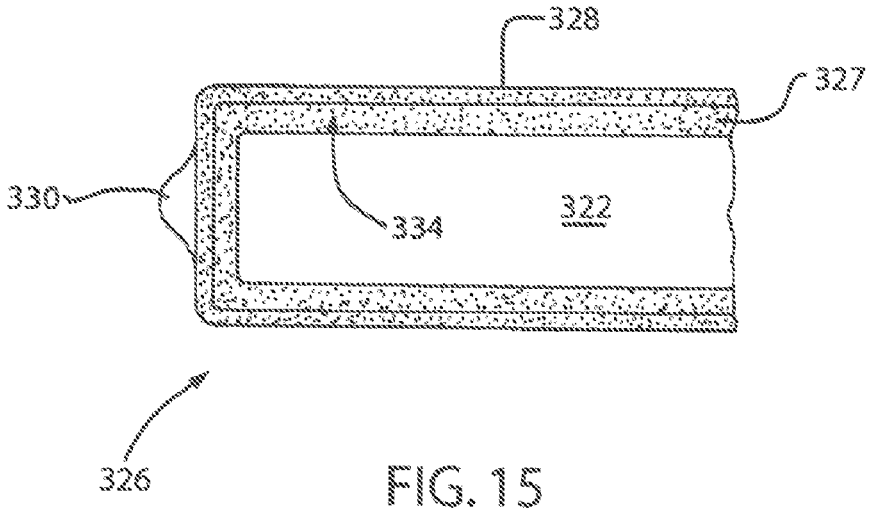
FIG. 15 is a partial plan view of a sealing panel with attached film layer flap of the package of FIG. 13, as viewed from below, in its initial condition.
Figure 16:
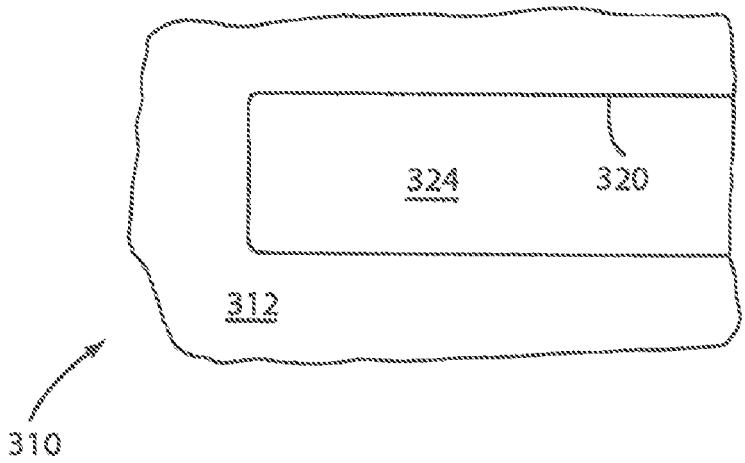
FIG. 16 is a partial plan view of the top of the package of FIG. 13, with the sealing panel not shown, prior to the package being opened.
Figure 17:
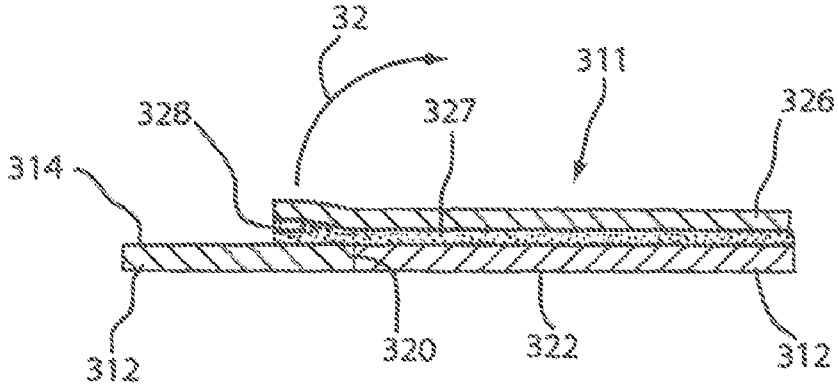
FIG. 17 is a partial enlarged cross-sectional view of the closure of FIG. 13, taken along line 17-17 of FIG. 13.
Figure 18:
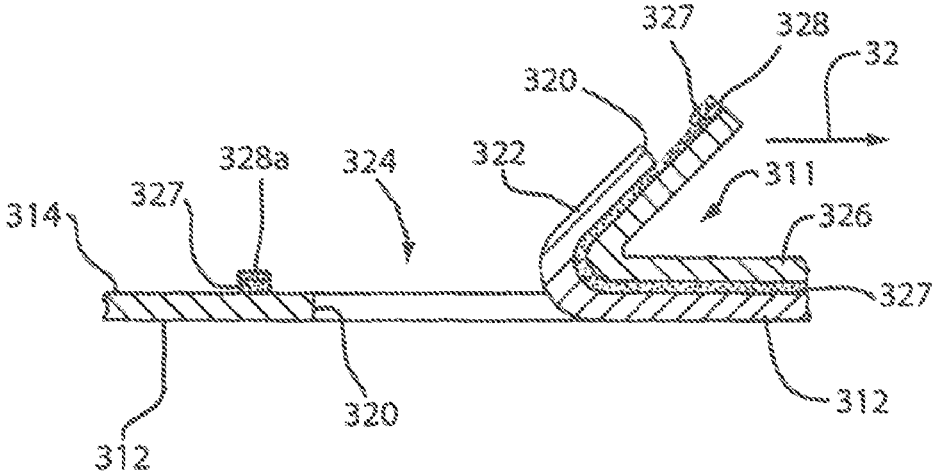
FIG. 18 is a partial enlarged cross-sectional view of the closure similar to FIG. 17 depicting an initial opening of the closure.

An additional alternative embodiment of a package with a package integrity feature, in accordance with the present invention, is provided in FIGS. 13-18, where like elements to those of package 10 are increased by 300. Package 310 is identical to package 210, except that rather than a coating of transferable material being initially applied to the film layer 214, a coating of transferable material 328 is first applied to the perimeter edge 334 of the sealing panel 326 prior to applying a releasable adhesive 327, as shown in FIGS. 15 and 17. Advantageously, the coating 328 can be applied to the back surface of sealing panel 326 using reverse printing. Advantageously, portions of the print layer of coating 328 are specially treated so as to weaken a bonding strength between the coating 328 and the label face stock of the sealing panel 326.

When the package 310 is opened for a first time, a portion of the adhesive 327 bonded to the coating 328 will be transferred from the sealing label 325 to the film layer 312 to form transferred coating 328*a* to the top of the package 310. (See FIGS. 15-18.) As a result, the transfer coating 328*a* creates a visual indicia on the top 314 of the package 310, which is visible due to slight misalignment of the sealing panel 326 with the film layer 312 when the sealing panel 326 is returned to its flat position, as shown in FIG. 14B. In addition, there will be a reduction in peel force between the sealing panel 326 and the film layer 312 after the package 310 has been opened and resealed for a first time due to portions of the sealing panel 326 missing portions of the adhesive 327, which is now transferred to the top 314 of the film layer 312 with coating 328*a*.

While FIGS. 1-18 show and describe closures 11, 111, 211 and 311 as forming the opening of a wrapper which defines packages 10, 110, 210 and 310, the closure may form a top of other packages having resealable openings, such as those described in U.S. patent application Ser. No. 11/193,613, herein incorporated by reference and, thus, the closure can form a closure over a thermoform tray having a sealing panel or layer as a lidding material over the top of the tray.

Figure 19:
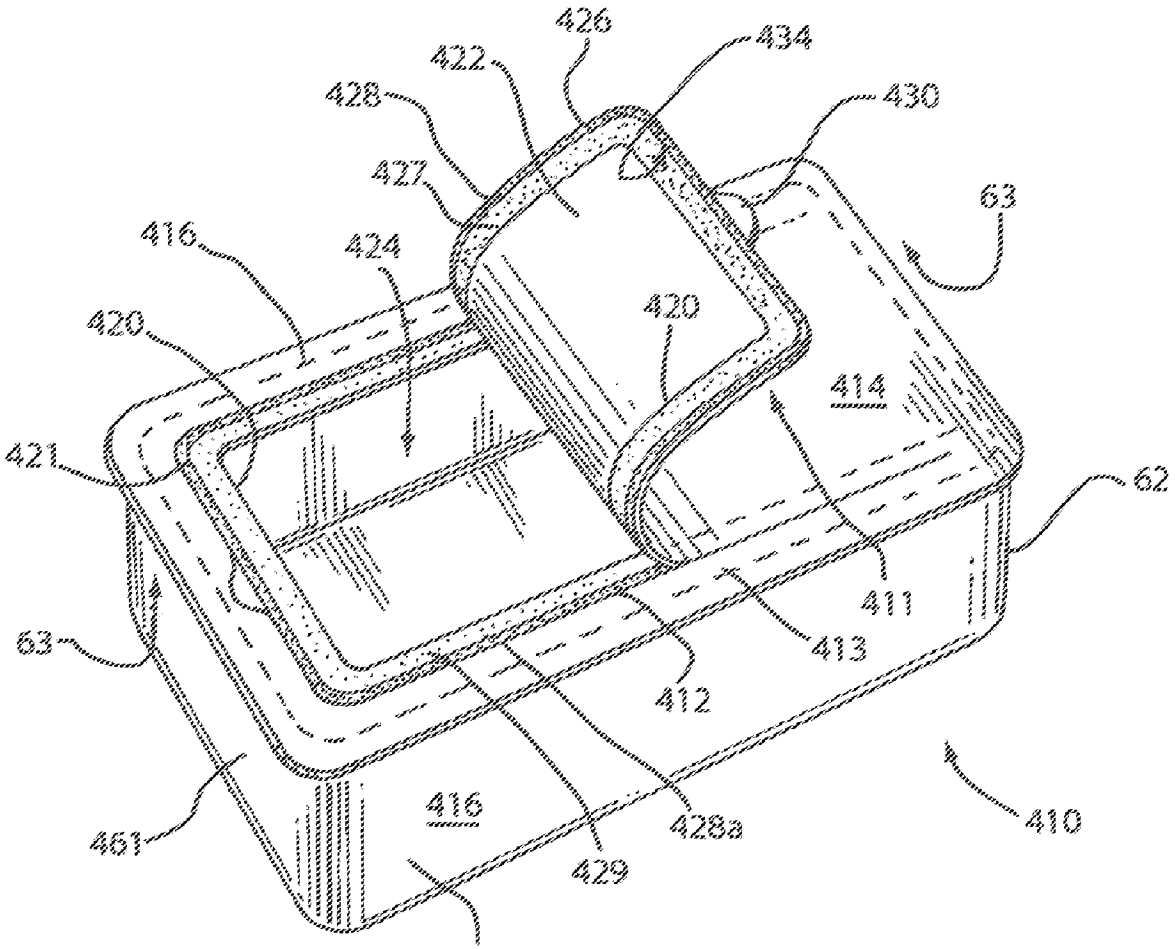
FIG. 19 is a perspective view of another package, including a closure that has been opened, in accordance with the present invention.

Referring to FIG. 19, where like elements to those of the embodiments of FIGS. 1-6 are increased by 400, package 410 comprises a thermoform tray 460 which forms sides 416 and ends 461, 462. A two-ply film material comprising an inner film layer 412 and outer film layer 413 are sealed to flange 463 of the thermoform tray 460. Like packages 10, 110, 210, 310, pulling back tab 430 separates the sealing panel 426 from the outer film layer 413 and separates the panel 422 from the inner film layer 412.

As with package 10, package 410 has a coating of transferable material 428 deposited on the perimeter 434 of the sealing label 426 and adhesive 427 formed around the perimeter of the inner film layer 412 adjacent the second tear line 421, which lies directly underneath the coating 428 when the sealing panel is laid flat on the top 414 of the package 410. Like package 10, peeling back the sealing panel 426 for a first time transfers a portion of the coating 428 to adhesive 429. When the sealing panel 426 is returned to its flat position, a portion of the transferred coating 428*a* will be visible when viewing the top of the package 410, due to a slight misalignment of the sealing panel 426 with the inner layer 412, in a similar manner as with package 10.

Although package 410 is described as having closure 411, package 410 can incorporate any of the closures 11, 111, 211 and 311. It will now be evident to one of ordinary skill in the art that the present resealable package with package integrity features provides advantages not found in prior packages.

Although the invention has been described above in relation to preferred embodiments thereof, it will be understood by those skilled in the art that variations and modifications can be effected in these preferred embodiments without departing from the scope and spirit of the invention.

The invention claimed is:

1. A package having a package integrity enclosure comprising:

a top having a first film layer and a second film layer, an access opening in the top, the access opening formed in the first film layer by a first tear line and a sealing panel formed in the second film layer by a second tear line, prior to opening the package the sealing panel covering the access opening and sealingly engaging the top around the access opening so as to originally seal the package and reseal the package after a first opening;

a margin of the sealing panel extends beyond the first tear line forming the access opening, a resealable adhesive is disposed on the margin of the sealing panel or on the first film layer facing the margin;

a perimeter portion of the margin or the first film layer facing the perimeter portion of the margin having a coating applied thereto such that the margin of the sealing panel or the first film layer facing the margin has inner and outer concentric areas wherein the inner concentric area has the resealable adhesive disposed thereon and the outer concentric area has at least the coating disposed thereon, the coating providing a tamper evident feature; and wherein upon initial opening of the package, at least a portion of the coating that is adhered to the other of the perimeter portion of the margin or the first film layer facing the perimeter portion of the margin separates therefrom such that upon reclosing, at least a portion of the coating is visually exposed beyond the perimeter portion of the margin upon misalignment of the sealing panel in reclosing, to provide an indication that the package has been previously opened.

2. The package of claim 1, wherein a bond strength between the adhesive and the coating is stronger than a bond strength between the coating and either the sealing panel or the top.

3. The package of claim 1, wherein the coating is selected from the group consisting of paint and ink.

4. The package of claim 1 wherein the resealable adhesive is disposed upon the margin of the sealing panel and the coating is disposed on top of a portion of the resealable adhesive, which is disposed on the perimeter portion of the margin.

5. The package of claim 1 wherein the resealable adhesive is disposed upon the first film layer facing the margin of the sealing panel and the coating is disposed directly to the perimeter portion of the margin of the sealing panel.

6. The package of claim 1 further comprising a second adhesive disposed on the first film layer adjacent the second tear line of the second film layer such that the second adhesive is adjacent the outer concentric area of coating disposed upon the margin of the sealing panel.

7. The package of claim 6 wherein the coating is disposed on the outer concentric area of the margin prior to initial opening of the package and upon initial opening of the package the coating separates from the sealing panel and remains adhered to the second adhesive disposed on the first film layer.

8. The package of claim 6 wherein the resealable adhesive is configured to reseal the package after initial opening and wherein the second adhesive has undergone a deadening effect due to the coating and wherein the outer concentric area of the margin of the sealing panel does not substantially reseal to the first film layer.

9. The package of claim 6 wherein the coating of material does not match the color of the second film layer.

10. The package of claim 1 wherein the resealable adhesive is disposed upon the margin of the sealing panel and the coating is initially disposed upon outer concentric area of the inner film layer adjacent the second tear line of the second film layer and, upon opening, at least a portion of the coating separates from the inner film layer and adheres to the resealable adhesive disposed upon the margin of the sealing layer.

11. The package of claim 10 wherein the coating adhered to the resealable adhesive on the outer concentric area of the inner film layer provides a deadening effect to portions of the outer concentric area and a reduction in required peel force between the sealing panel and first film layer due to the deadening effect of the coating adhering to the resealable adhesive thereby providing an indication of previous opening.

12. The package of claim 1 wherein the coating is disposed upon the outer concentric area of the margin of the sealing layer upon which the resealable adhesive is disposed and wherein, upon initial opening, at least a portion of the coating and resalable adhesive are separated from the margin of the sealing layer and are adhered to the first film layer.

13. A package integrity indicating closure, the closure comprising:

a film layer forming the top of a container and having a flap defining an access opening to gain access to the contents of the container;

a sealing panel completely covering the flap of the film layer, the sealing panel and the flap being permanently adhered to one another to thereby form the access opening, a margin of the sealing panel includes a portion of the sealing panel extending beyond the access opening;

releasable adhesive provided on either the margin of the sealing panel facing the film layer or on the film layer facing the margin the releasable adhesive configured to adhere the sealing panel to the film layer, the sealing panel being releasable from the film layer by pulling the sealing panel back in a peeling direction and reclosable against the top to seal the access opening when the sealing panel is moved back against the top;

a coating of transferable material on either the margin of the sealing panel on a first surface thereof facing the film layer or on the film layer on a second surface thereof facing the margin of the sealing panel, the coating being adhered near a perimeter of the first or second surfaces so that an inner area has the releasable adhesive and an outer area concentric with the inner area has at least the coating; and wherein the coating is transferable from the sealing panel to the film layer or the film layer to the sealing panel to thereby provide a visual indication that the closure has been previously opened, the visual indication being at least a portion of the coating that is visually exposed beyond the sealing panel upon misalignment in reclosing the sealing panel on the film layer.

14. The package integrity indicating closure of claim 13, wherein a bond strength between the releasable adhesive and the coating is stronger than a bond strength between the coating and the film layer.

15. The package integrity indicating closure of claim 14, wherein a bond strength between the releasable adhesive and the film layer is stronger than a bond strength between the coating and the sealing panel.

16. The package integrity indicating closure of claim 13, wherein a bond strength between the releasable adhesive and the coating is stronger than a bond strength between the coating and the sealing panel.

17. The package integrity indicating closure of claim 13, wherein a bond strength between the releasable adhesive and the coating is greater than a bond strength between the film layer and the coating.

18. The package integrity indicating closure of claim 13, wherein the coating is along the film layer in a location directly under the perimeter of the sealing panel.

19. The package integrity indicating closure of claim 13, wherein the coating is of a different color or pattern than that of the film layer.

20. The package integrity indicating closure of claim 13, wherein a perimeter edge of the sealing panel is nonlinear.

21. The package integrity indicating closure of claim 20, wherein the perimeter edge of the sealing panel is zigzag patterned.

22. A package integrity indicating closure, the closure comprising:

an at least two-ply material comprising a first film layer adhesively joined to a second film layer;

a first tear line formed into the first film layer, defining a first panel for providing an access opening through the first film layer when separated from the first film layer along the first tear line;

the second film layer having a second layer tear line defining a sealing panel which completely covers the first panel, the first panel and the sealing panel being permanently joined to each other to form the access opening;

the sealing panel releasably adhered to the first film layer such that the sealing panel is separable from the first film layer to expose the access opening;

a margin of the sealing panel extends beyond the first tear line formed into the first film that forms the first panel that provides the access opening, a resealable adhesive is disposed on the margin of the sealing panel or on the first film layer facing the margin;

a perimeter portion of the margin or the first film layer facing the perimeter portion of the margin has a coating of transferable material applied thereto such that the margin of the sealing panel or the first film layer facing the margin has inner and outer concentric areas wherein the inner concentric area has the resealable adhesive disposed thereon and the outer concentric area has at least the coating disposed thereon, the coating providing a tamper evident feature so that upon opening the closure a portion of the coating is transferred between the sealing panel and the first film layer to provide a visual indication that the closure has been opened after the sealing panel has been peeled back from the first film layer for a first time and the sealing panel releasably separates from the first film layer to expose the access opening; and wherein at least a portion of the coating of transferable material is visually exposed beyond the perimeter of the sealing panel after reclosure of the sealing panel, upon misalignment of the sealing panel in reclosing.

23. The package integrity indicating closure of claim 22, wherein the coating is selected from the group consisting of paint and ink.

24. The package integrity indicating closure of claim 22, wherein the second tear line is in the form of a non-straight line.

25. The package integrity indicating closure of claim 24, wherein the second tear line is in a zigzag pattern.

26. A package integrity indicating food container comprising:

a tray;

an at least two-ply material comprising an inner layer adhesively joined to an outer layer to form a top over the tray, the top formed to provide an access opening for access to food items disposed in the tray;

the inner layer having a first panel, the outer layer having a sealing panel formed therein which completely covers the first panel, the first panel and the sealing panel being permanently joined to each other to form the access opening into the container;

a margin of the sealing panel extends beyond the first panel of the inner laver, a resealable adhesive is disposed on the margin of the sealing panel or on the inner layer facing the margin for adhering the sealing panel to the inner layer, the sealing panel being releasable from the inner layer and by pulling the sealing layer back in a peeling direction and reclosable against the top to seal the opening when the sealing panel is moved back against the top;

a perimeter portion of the margin or a portion of the inner film layer facing the perimeter portion of the margin having a coating of transferable material disposed thereto such that the margin of the sealing panel or the inner film layer facing the margin has inner and outer concentric areas wherein the inner concentric area has the resealable adhesive disposed thereon and the outer concentric area has at least the coating disposed thereon, the coating providing a tamper evident feature;

whereby, upon opening the closure for a first time, at least a portion of the coating is transferred between the outer layer and the inner layer to provide a visual indication that the closure has been opened, the visual indication being at least a portion of the coating that is visually exposed beyond the perimeter of the sealing panel upon misalignment in reclosing.

27. The integrity indicating food container of claim 26, wherein the food items are selected from the group consisting of cookies, crackers, peanuts, cheese, sliced meats and semi-solid foods.

* * * * *

UNITED STATES PATENT AND TRADEMARK OFFICE

CERTIFICATE OF CORRECTION

PATENT NO. : 8,114,451 B2
APPLICATION NO. : 11/616386
DATED : February 14, 2012
INVENTOR(S) : Gladys Odette Sierra-Gomez et al.

It is certified that error appears in the above-identified patent and that said Letters Patent is hereby corrected as shown below:

IN THE CLAIMS:

Column 9, line 38, insert --,-- after --margin-- therefor.

Signed and Sealed this
Twenty-fourth Day of April, 2012

David J. Kappos

David J. Kappos
*Director of the United States Patent and Trademark Office*